US011696663B2

(12) United States Patent
Watkins

(10) Patent No.: US 11,696,663 B2
(45) Date of Patent: Jul. 11, 2023

(54) PAPER TOWEL HOLDER

(71) Applicant: Patricia Watkins, Pensacola, FL (US)

(72) Inventor: Patricia Watkins, Pensacola, FL (US)

( * ) Notice: Subject to any disclaimer, the term of this patent is extended or adjusted under 35 U.S.C. 154(b) by 7 days.

(21) Appl. No.: 17/342,655

(22) Filed: Jun. 9, 2021

(65) Prior Publication Data

US 2022/0395144 A1 Dec. 15, 2022

(51) Int. Cl.
*A47K 10/38* (2006.01)

(52) U.S. Cl.
CPC ..... *A47K 10/38* (2013.01)

(58) Field of Classification Search
CPC ..... A47K 2010/328; A47K 10/38; A47K 10/3612; A47K 10/3656
See application file for complete search history.

(56) References Cited

U.S. PATENT DOCUMENTS 3,843,071 A * 10/1974 Graham ..... B65D 83/0805 206/397
4,936,452 A * 6/1990 Pauley ..... A47K 10/3827 225/84
6,098,836 A * 8/2000 Gottselig ..... A47K 10/3818 221/45
7,322,544 B2 * 1/2008 Collins ..... A47K 10/40 242/598.5
9,027,872 B2 * 5/2015 Flood ..... A47K 10/38 242/596.8
9,480,372 B1 * 11/2016 Taylor ..... A47K 10/42
2015/0196173 A1 * 7/2015 Hoefte ..... A47K 10/3836 222/153.01
2019/0200816 A1 * 7/2019 Moore ..... A47K 10/38

* cited by examiner

*Primary Examiner* — Patrick H Mackey
(74) *Attorney, Agent, or Firm* — Lyman Moulton, Esq.; Moulton Patents, PLLC

(57) ABSTRACT

The Patty Paper Towel Holder is the only product of its kind that has a capability of ensuring paper towels stay dry and clean, preventing elements from damaging the roll. This unprecedented product is uniquely designed with durable materials to ensure sustainability and the teeth slit is specifically designed to enable users to simply and quickly pull the paper towel away for immediate use. The disclosed paper towel holder includes an outer shell comprising an egress slot for a paper towel therein and configured longitudinally between a first end and a second end of the shell. The disclosure also includes a hollow pole engineered to be received annularly in each of the two ends of the outer shell.

6 Claims, 1 Drawing Sheet

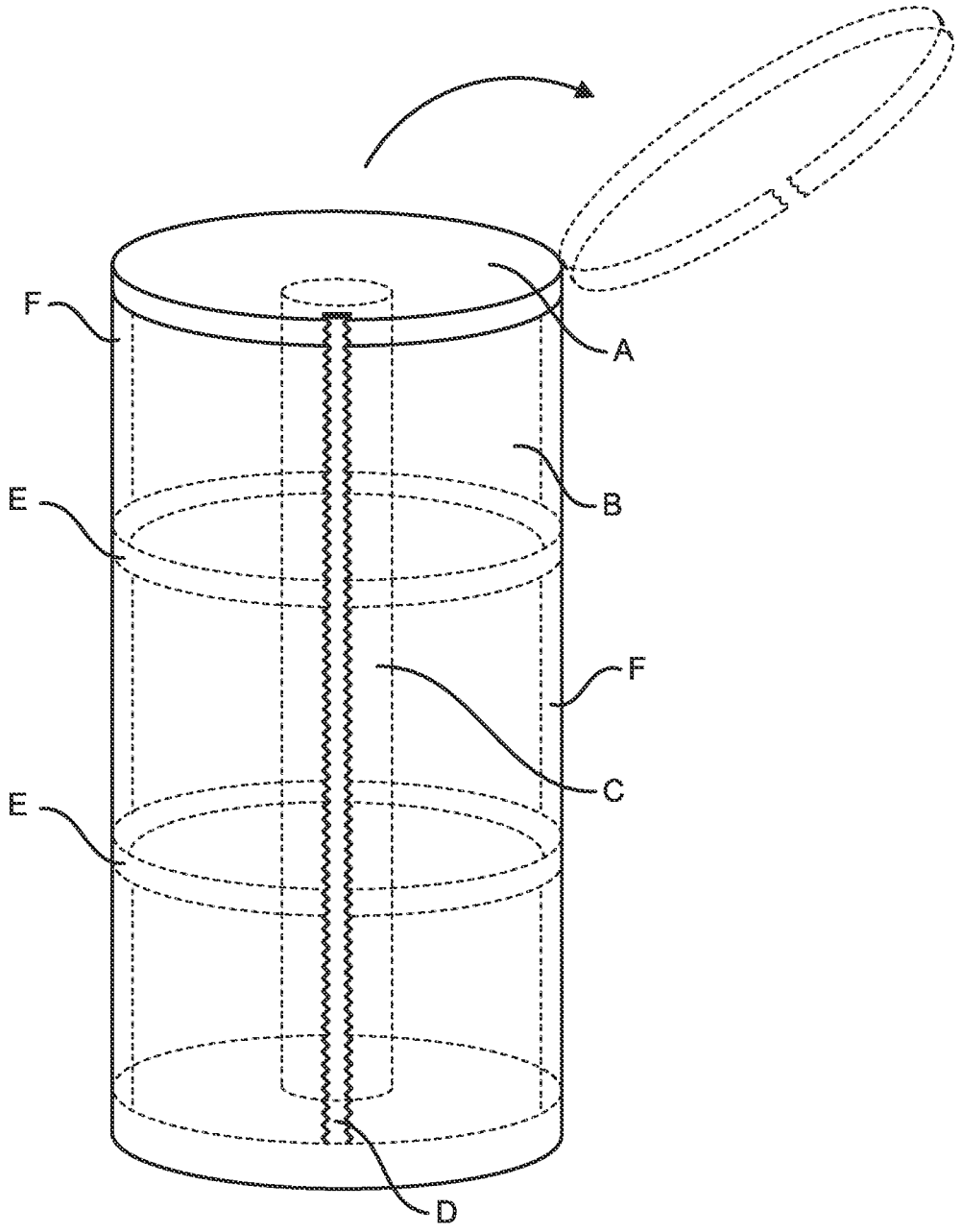
F
A
B
E
F
C
E
D

PAPER TOWEL HOLDER

BACKGROUND

Paper towels are used by individuals on almost a daily basis as the multi-functional accessory serves a wide variety of purposes for individuals; yet, it is most commonly used in the kitchen. Considering most individuals must hold the paper towel roll when attempting to cut off an individual section, the user's hand is oftentimes wet or dirty thus contaminating the roll. This creates an inconvenient and wasteful situation considering the user ends up dirtying or wetting multiple sheets of paper prior to its use.

An apparatus or device to simplify the process of tearing or cutting off an individual section of paper towel without contaminating the remaining roll. There have been no products available as original equipment or as an aftermarket to address this problem either.

There exists a need for an apparatus or device such as this Paper Towel Holder that is not being met by any known or disclosed device or system of present.

SUMMARY OF THE INVENTION

The main purpose of the Paper Towel Holder is to provide users with a convenient paper towel holding unit that prevents a paper towel roll from getting contaminated from water and/or food debris.

The disclosed paper towel holder includes an outer shell comprising an egress slot for a paper towel therein and configured longitudinally between a first end and a second end of the shell. The disclosure also includes a hollow pole engineered to be received annularly in each of the two ends of the outer shell.

BRIEF DESCRIPTION OF THE DRAWINGS

FIG. 1 is a front perspective view of the Paper Towel Holder apparatus in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a front perspective view of the Paper Towel Holder showing Lid referenced as A., Paper towel container, also known as an outer shell referenced as B., Pole referenced as C., Teethes slit, also known as an egress slot to pull paper towel frim referenced as D., in accordance with an embodiment of the present disclosure. Embodiments of the egress slot D further comprises a crenelation on a first and a second longitudinal edge of the egress slot D, the crenelation configured to strain a sanitary fluid from the paper towels. The paper towel container as an outer shell includes the egress slot D for a paper towel therein and configured longitudinally between a first end and a second end of the outer shell B. The pole C is hollow in order to configured to be received annularly in each of the two ends of the outer shell. The egress slot D further comprises a row of teeth configured to allow egress of the paper towel therefrom and to strain a sanitary fluid from the paper towel. The egress slot D further includes a first row and a second row of teeth on either longitudinal side of the egress slot D. One of the first end and the second are removable from the outer shell. The hollow pole C rotates within an annular groove in each of the first end and the second end. The egress slot D teeth configured complementary to each other to allow a straining of a sanitary fluid from each paper towel. An annular fluid channel E is disposed on an inside surface of the outer shell B. Multiple annular fluid channels E are disposed on an inside surface of the outer shell B. Single and multiple longitudinal fluid channels F are disposed on an inside surface of the outer shell D. Embodiments include single and multiple intersecting annular fluid channels E and longitudinal fluid channels F on an inside surface of the outer shell D. A porous annular fluid vessel on an inside of the outer shell is configured to disperse a sanitary fluid there around. A boss disposed on an inside of one of the first end and the second end and configured to maintain the egress slot in fixed position relative to the hollow pole.

The present disclosed Paper Towel Holder, also known as "Patty Paper Towel Holder", introduces a novel storage unit with a lid that enables users to easily rip off one paper towel without tarnishing the rest of the roll. This innovative product holds a standard roll and safeguards it against any liquids, splashes, or food splatters that are common in kitchen areas. The user simply places the roll into the container, closes the lid, and then accesses sheets, as needed, via the slit on the side of the unit. This in return guarantees the paper towel remains dry and sanitized at all times; thus, the Patty Paper Towel Holder provides users with a highly functioning paper towel vessel that enables a person to easily reach for a paper towel without ruining the entire roll. The disclosure also includes sanitary wipe embodiments designed to retain and distribute wet paper towels for sanitizing and cleaning purposes.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A paper towel holder, comprising an outer shell configured to define a plurality of intersecting annular fluid channels with a plurality of longitudinal fluid channels on an inside surface of the outer shell and comprising an egress slot for a paper towel therein configured longitudinally between a first end and a second end of the shell; and a hollow pole configured to be received annularly in each of the two ends of the outer shell.

2. The paper towel holder of claim 1, wherein the egress slot further comprises a row of teeth configured to allow egress of the paper towel therefrom and to strain a sanitary fluid from the paper towel.

3. The paper towel holder of claim 1, wherein the egress slot further comprises a first row and a second row of teeth.

4. The paper towel holder of claim 1, wherein one of the first end and the second are removable from the outer shell.

5. The paper towel holder of claim 1, wherein the hollow pole rotates within an annular groove in each of the first end and the second end.

6. The paper towel holder of claim 1, wherein the egress slot further comprises teeth configured complementary to each other to allow a straining of a sanitary fluid from each paper towel.

* * * * *